US007090097B1

(12) United States Patent
Kazarian et al.

(10) Patent No.: US 7,090,097 B1
(45) Date of Patent: Aug. 15, 2006

(54) MULTI-CHAMBERED CONTAINER FLUID SELECTION VALVE

(76) Inventors: Randal N. Kazarian, P.O. Box 40629, Santa Barbara, CA (US) 93140-0629; David P. Mills, 73 Fraser La., Ventura, CA (US) 93001

( * ) Notice: Subject to any disclaimer, the term of this patent is extended or adjusted under 35 U.S.C. 154(b) by 224 days.

(21) Appl. No.: 10/877,017

(22) Filed: Jun. 25, 2004

Related U.S. Application Data

(62) Division of application No. 10/241,851, filed on Sep. 13, 2002, now Pat. No. 6,769,573.

(51) Int. Cl.
*B67D 5/06* (2006.01)

(52) U.S. Cl. ..... 222/144.5; 222/485

(58) Field of Classification Search ..... 222/136, 222/142.6, 142.9, 144.5, 383.3, 485, 486
See application file for complete search history.

(56) References Cited

U.S. PATENT DOCUMENTS 3,130,874 A * 4/1964 Bulmer ..... 222/142.8
5,027,981 A * 7/1991 Magister ..... 222/137
5,398,846 A * 3/1995 Corba et al. ..... 222/1
6,302,301 B1 * 10/2001 Vette ..... 222/142.6
6,550,640 B1 * 4/2003 Smith ..... 222/1
6,659,311 B1 * 12/2003 Prueter ..... 222/136
6,769,573 B1 * 8/2004 Kazarian et al. ..... 222/136

* cited by examiner

*Primary Examiner*—Joseph A. Kaufman
(74) *Attorney, Agent, or Firm*—Albert O. Cota

(57) ABSTRACT

A selection valve (10) for use with a multi-chambered fluid container having outlet openings in communication with the fluid container chambers. The selection valve (10) utilizes an outer housing (12) having a bore (14) for receiving a fluid from the multi-chambered container. An upper gasket (20) engages an inner surface (16) of the outer housing (12) and an inner housing (28) having intake ports (34) that interface with the upper gasket, permitting communication between the outer housing (12) and the fluid container. A spring detent (46) is disposed upon the inner housing with protruding pins (48) that ride upon a rotating detent ring (50). When the housing (12) and the detent ring (50) rotate, the pins (48) enter radial grooves (54) and (55) causing the housing to remain at a desired location. A closure assembly is snapped onto the inner housing to permit a fluid path to be formed between a specific compartment in the container and the bore (14) in the outer housing.

3 Claims, 17 Drawing Sheets

MULTI-CHAMBERED CONTAINER FLUID SELECTION VALVE

This application is a Divisional patent application of application Ser. No. 10/241,851, filing date Sep. 13, 2002 now U.S. Pat. No. 6,769,573.

TECHNICAL FIELD

The present invention pertains generally to valves for containers and more specifically to a valve that permits selection of one of a number of fluids from within a multi-chambered container utilizing a single dispensing method.

BACKGROUND ART

Previously, there have been many types of valves used to provide an effective means to pre-select a specific fluid from a multi-chambered container.

A search of the prior art did not disclose any patents that possess the novelty of the instant invention, however the following U.S. patents are considered related:

| U.S. Pat. No. | Inventor | Issue Date |
|---|---|---|
| 3,685,739 | Vanier | Aug. 22, 1972 |
| 3,701,478 | Tada | Oct. 31, 1972 |
| 5,152,431 | Gardner, et al. | Oct. 6, 1992 |
| 5,370,275 | Mills et al. | Dec. 6, 1994 |
| 5,433,350 | Graubart | Jul. 18, 1995 |
| 5,685,351 | Kazarian, et al. | Nov. 11, 1997 |

U.S. Pat. No. 3,685,739 discloses a combined closure and liquid pumping device that screws onto a container. The invention also includes a pump with a nozzle connected to a conduit within the container. The pump includes check valves and the nozzle has the capability of being adjustable to the extent that it may be shut off completely.

U.S. Pat. No. 3,701,478 discloses a hand sprayer that has a body with a cylinder and stock portion, along with a piston and a handle. The piston includes a through passage integrally formed therein, and a check valve with a one piece resilient element. A spraying cartridge with a resilient element having a recess in which a spring seats forms a piston ring, thus preventing leakage. A spring returns the piston after operation of the handle.

U.S. Pat. No. 5,152,431 discloses a single pump used to dispense liquid from one of a number of compartments in a container. The pump is mounted on the container vessel and rotates with respect to the container to select the liquid to be pumped and dispensed. An elbow tube is positioned above a dip tube located in each chamber of the container, and an O-ring in each tube prevents leakage while allowing the desired compartment to be in communication with the pump.

U.S. Pat. No. 5,370,275 is my prior patent upon which the instant improvements are based. The invention is for an adapter that is mounted between a liquid containing vessel having multiple chambers, and a conventional hand sprayer pump. The adapter has at least two inlet ports that are in respective communication with a single outlet port. An outer housing is affixed to the pump head and an inner housing is releasably affixed to reservoirs. The position of the outer housing may be manually rotated with respect to the inner housing and its location is determined by means of a compression spring-loaded detent. Rotation of the outer housing sequentially selects the desired intake port of the fluid container.

U.S. Pat. No. 5,433,350 discloses a pump apparatus for dispensing a selected compartment in a container having multiple compartments. Each compartment is communicated with dip tubes opening through bores located in a base disposed at the top of the container. A thumb wheel with a single bore is rotated to select the appropriate bore. The thumb wheel is accessed through a window in the pump with indicia indicating the selection.

Kazarian, et al. in U.S. Pat. No. 5,685,351 discloses my filler adapter mounted on the open end of a multichambered container. The device permits individual chambers to be emptied or filled without contaminating adjacent chambers. The adapter has a closing means that engages the container and includes plugs and a gasket that seals all but a selected chamber. An opening overlays the selected chamber and communicates with a conical lumen within the adapter. A funnel may be placed in the opening of the conical lumen for filling. Draining is accomplished by inverting the container.

DISCLOSURE OF THE INVENTION

The invention is directed to a number of improvements to my U.S. Pat. No. 5,370,275 which have simplified construction, enhanced operational characteristics and adaptability to other dispensing methods.

The primary object of the instant invention is to incorporate a simplified manufacturing process by the use of a single unitary injection molded, spring detent. Previously two plastic rod-shaped detents were utilized, with a compression spring in-between which was positioned within a bore that penetrated the inner housing. This approach requires additional time to separately install the individual parts, thereby making robotic assembly techniques extremely difficult since the parts are small and must sequentially fit into the bore of the housing. The improved molded spring detent is fabricated as a single unitary member of injection molded plastic, and the inner housing has been modified to contain a mating groove on its sides which permits the discrete detent to be installed by simply urging it into the groove from the side and snapping it into in place. When installed, the detent has sufficient resiliency to force the extending polymer spring shaped arms outward and to spring back after being compressed, in exactly the same manner as a conventional spring loaded detent.

An important object of the invention, at least in the first two embodiments, is the incorporation of a straight through flow path within the valve which permits adequate drainage and venting without the necessity of using check valves. This improvement simplifies construction as not only is a two part assembly eliminated but the entire check valve is no longer required, thus enhancing the reliability of the valve.

Another object of the invention is the use of an improved upper gasket with molded-in port and perimeter o-rings. Previously, in my patent U.S. Pat. No. 5,370,275 the upper gasket was simply a flat one-piece gasket with multiple ports created for the fluid flow path. Unfortunately, it was discovered that when the gasket was formed perfectly flat it provided too much surface area, thus resulting in excessive friction between the upper gasket and rotating outer housing. The improved molded-in port and perimeter o-rings, which are integrally formed on both sides of the gasket, have a raised radial surface with a groove in the middle. The radial surface forms not only a vacuum-tight seal, but the double lip configuration made by the groove permits the material to compress with a minimum of friction and considerably less abrasion when rotating.

Still another object of the invention permits all components in the fluid selection valve to be capable of being assembled by automated robotic disciplines or a simple by hand snap fit assembly means. This ease of assembly is accomplished by the use of molded-in snap beams and slots located at two vertical locations as described infra in detail.

Yet another object of the invention is the reduction of component parts which is accomplished by the use of the integral molded spring detent described supra. The single element reduces the number of detent parts from the previously required three individual components to one easily handled and assembled part.

Another object of the invention is that the assembly of the spring detent into the inner housing forms "dual" opposing single fin guides which were previously embodied in the inner housing of my patent U.S. Pat. No. 5,370,275.

The final object of the invention is the flexibility of application, in that three embodiments of the outer housing are taught. The first embodiment is for a spout-shaped outer housing which permits both powders and liquids to be poured from the container, and by rotating the housing a shut-off position is attained. The second embodiment is for an outer housing with an upright spout with a push-pull closure on the distal end. This embodiment permits liquids to be dispensed from the container by pulling up the closure with one's fingers and closing is accomplished by pushing the closure. An improvement in the push-pull closure utilizes a molded-in plug in the closure which plugs the hole in the upright spout of the outer housing, rather than a conventional closure approach wherein the plug in the upright closes off the hole in the closure.

The third embodiment permits the invention to be adaptable to trigger spray bottles, much like my former patent U.S. Pat. No. 5,370,275 however, improvements have been made in the form of a pair of finger lift ledges and a pinch guard added to the outer surface of the outer housing. The pair of lift ledges protrude from the outer housing, thus allowing a single finger to support the entire container including the valve and trigger sprayer. This is a distinct advantage, as this addition permits valve use with symmetrically-shaped bottles which allows more volume in a reduced space, relative to offset and finger-grooved bottles. The pinch guard utility is also provided by the pair of protruding ledges, as one ledge is formed on each side of the trigger to prevent a user's finger from being pinched when the trigger is repetitiously squeezed. This improvement precludes the use of a more costly bottle configuration which would require molding in one side of the container or adding finger grooves, since the invention accomplishes the same task with a symmetrical bottle at no unnecessary expense.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
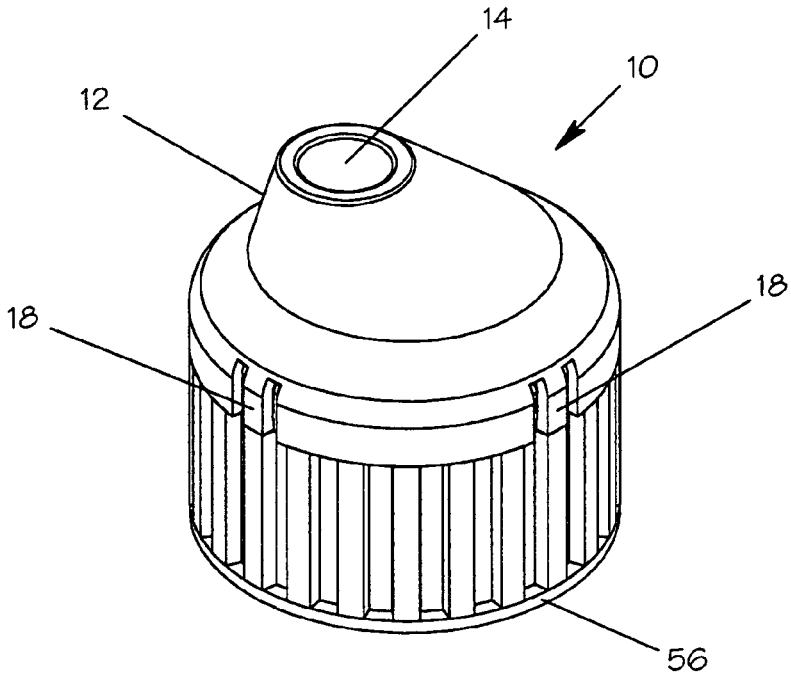
FIG. 1 is a partial isometric view of the first preferred embodiment.
Figure 2:
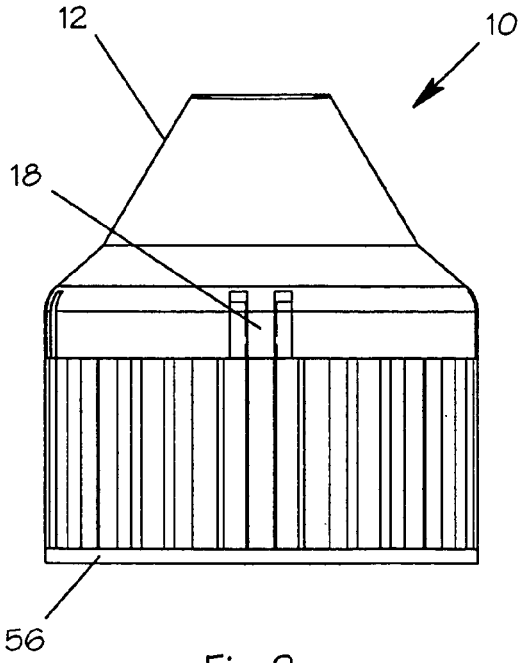
FIG. 2 is a front elevation view of the first embodiment.
Figure 3:
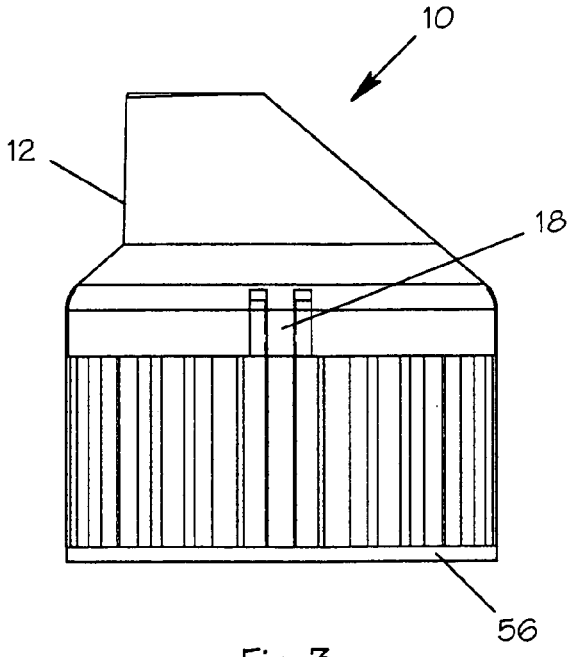
FIG. 3 is a right side elevation view of the first embodiment.
Figure 4:
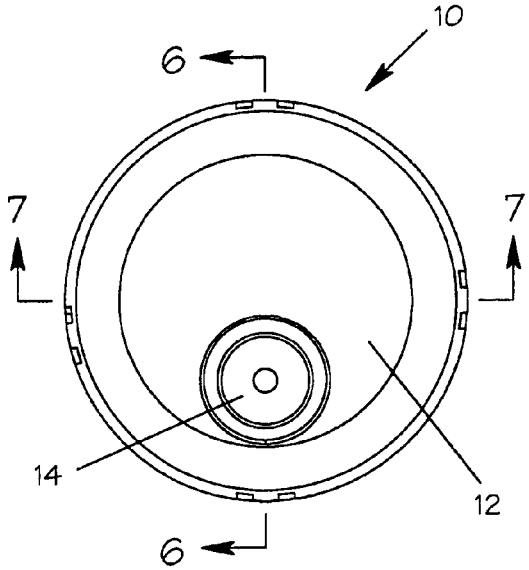
FIG. 4 is a top plan view of the first embodiment.
Figure 5:
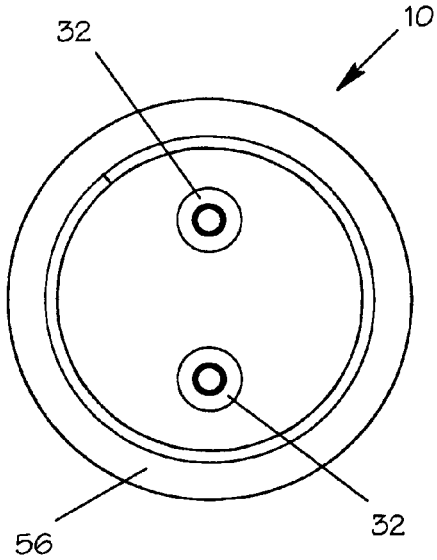
FIG. 5 is a bottom view of the first embodiment.
Figure 6:
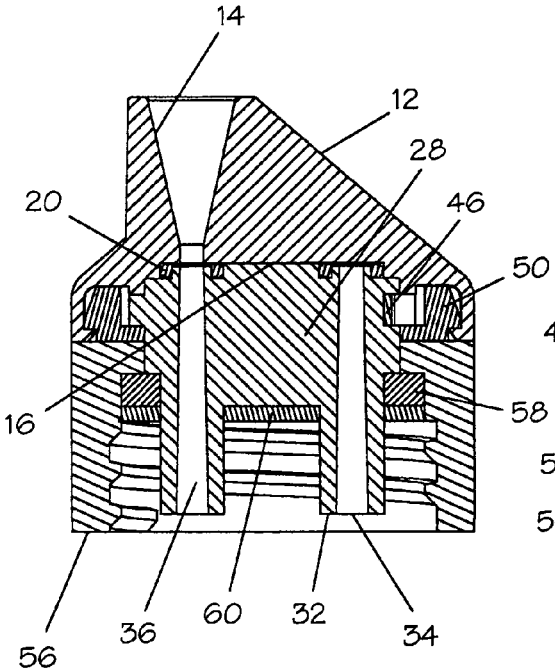
FIG. 6 is a cross-sectional view taken along lines 6—6 of FIG. 4.
Figure 7:
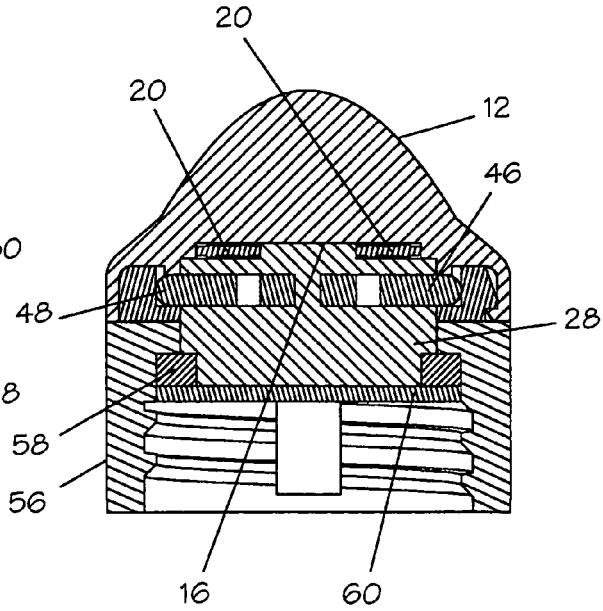
FIG. 7 is a cross-sectional view taken along lines 7—7 of FIG. 4.
Figure 8:
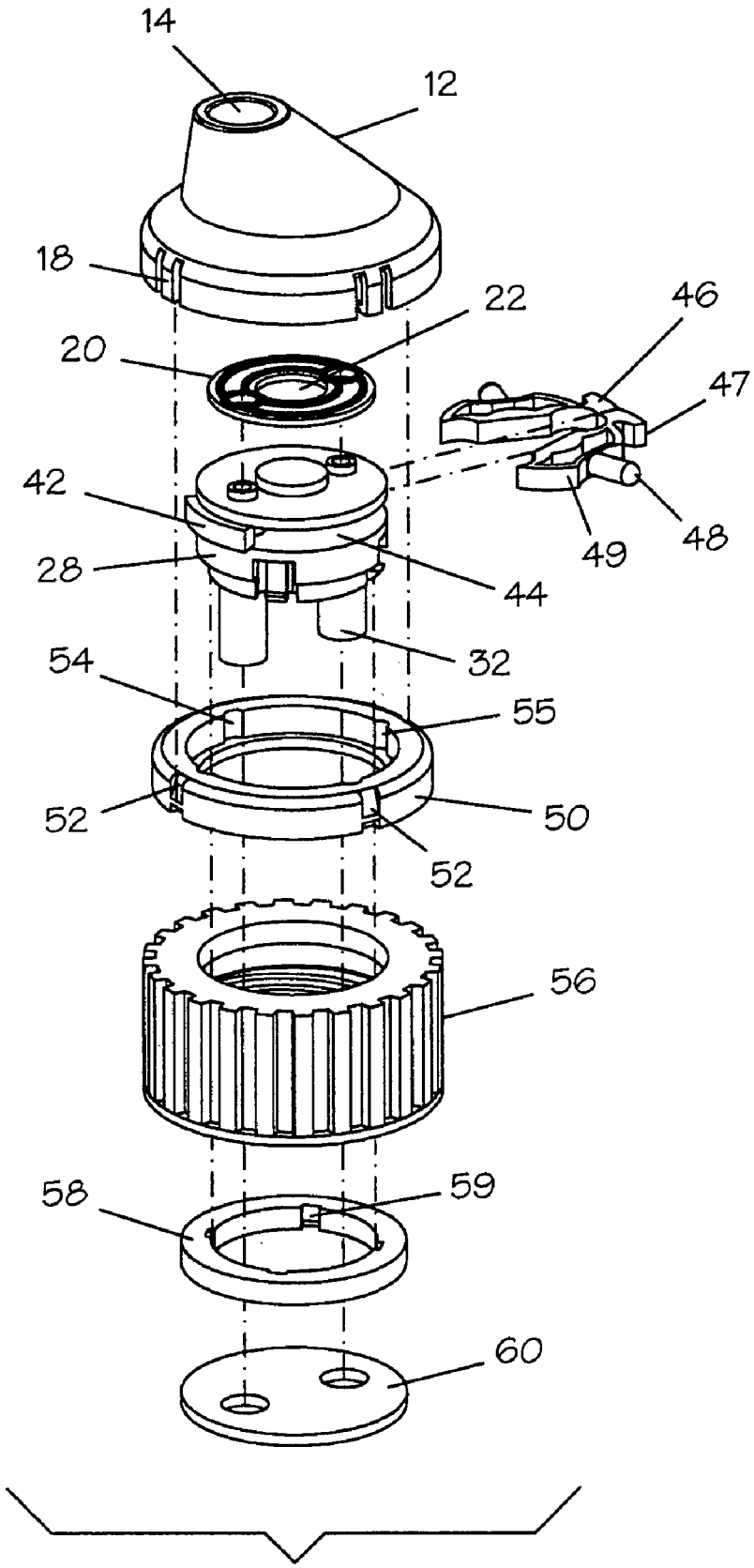
FIG. 8 is an exploded view of the first embodiment.
Figure 9:
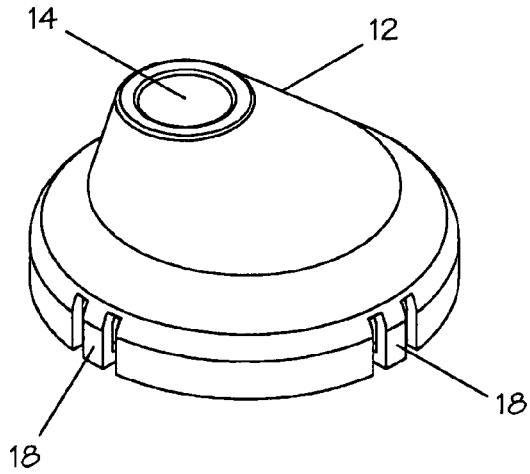
FIG. 9 is a partial isometric view of the spout-shaped outer housing of the first embodiment completely removed from the invention for clarity.
Figure 10:
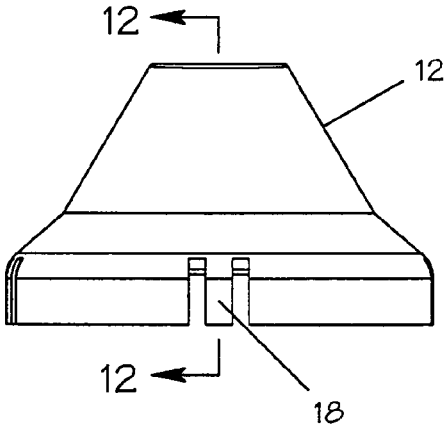
FIG. 10 is a front elevation view of the spout-shaped outer housing of the first embodiment completely removed from the invention for clarity.
Figure 11:
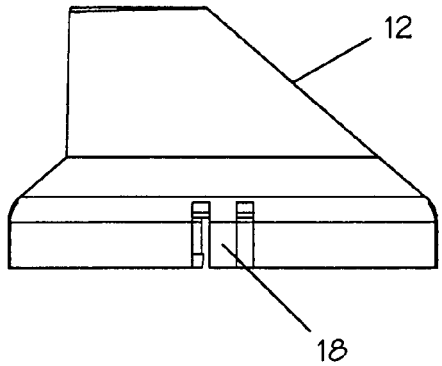
FIG. 11 is a right side elevation view of the spout-shaped outer housing of the first embodiment completely removed from the invention for clarity.

The best mode for carrying out the invention is presented in terms of a preferred, second and third embodiment. All three embodiments are basically the same in function and utilize the same components, with the exception of the outer housing which varies slightly in structure. The preferred embodiment, as shown in FIGS. 1–13 and 45–69, is comprised of a selection valve 10 that is used in conjunction with a multi-chambered fluid container, not shown, that has a plurality of container outlet openings in fluid communication with various container chambers for storing fluids. The container, which is sometimes referred to as a bottle, is well known in the art and is in common usage today, therefore it is deemed unnecessary to be illustrated in the drawings. The prior art multi-chambered container includes a pair of side-by-side isolated chambers. The liquids stored in the two chambers are not mixed until the liquids are poured from an opening on the top of the container. It should be noted that all three embodiments interface with this type of container by screwing onto a multiplicity of external threads that are located on the neck, and the containers may have any number of chambers, as the invention is adaptable to the individual requirements relative to the number and position of the dip tubes. The dip tubes attach to the inner housing of which two sizes of tubes may be employed. A smaller set of dip tubes fit up into the channels of an intake port at a lower intake end of the inner housing, which channels are tapered to lock such smaller dip tubes in place. A larger set of dip tubes, if used, would fit around the exterior of the protuberances at the lower intake end of the inner housing. It should also be noted, the protuberances at the lower intake end will extend partially down into the finish opening of such multi-chambered bottles.

The preferred embodiment of the invention, as shown assembled in FIGS. 1–7, includes an outer housing 12, illustrated in FIGS. 9–13, that includes an offset bore 14 that protrudes completely therethrougth for receiving and conducting a singular fluid from the multi-chambered container.

Figure 12:
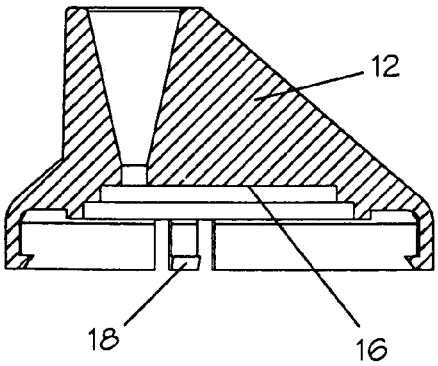
FIG. 12 is a cross sectional view taken along lines 12—12 of FIG. 10.
Figure 13:
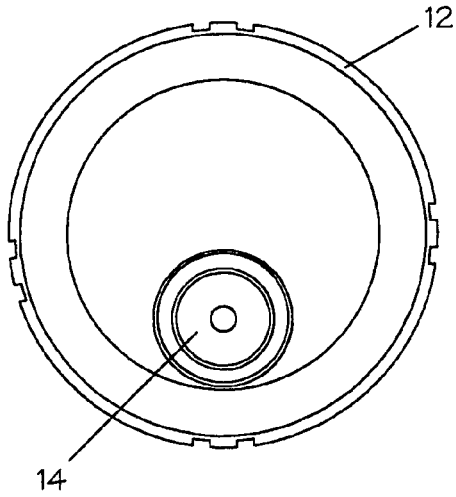
FIG. 13 is a top plan view of the spout-shaped outer housing of the first embodiment completely removed from the invention for clarity.
Figure 14:
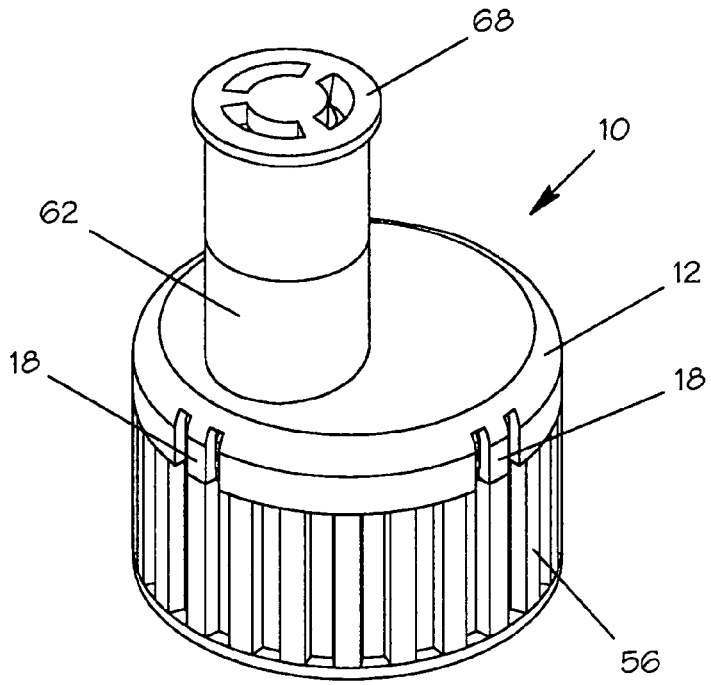
FIG. 14 is a partial isometric view of the second embodiment.
Figure 15:
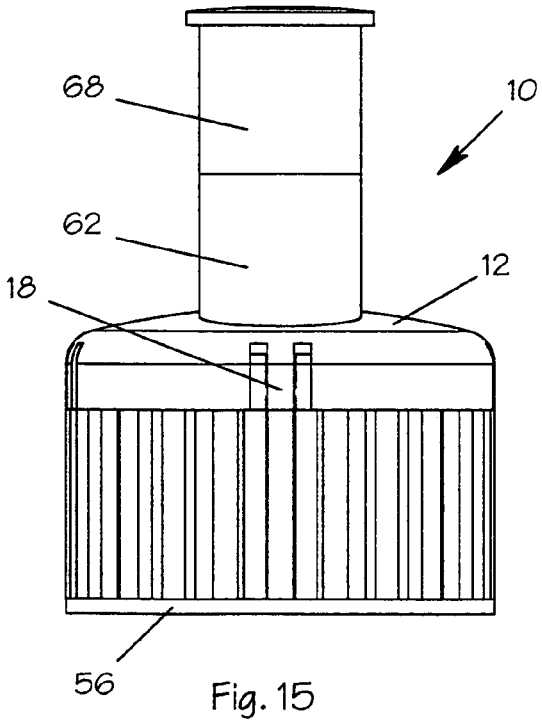
FIG. 15 is a front elevation view of the second embodiment.
Figure 16:
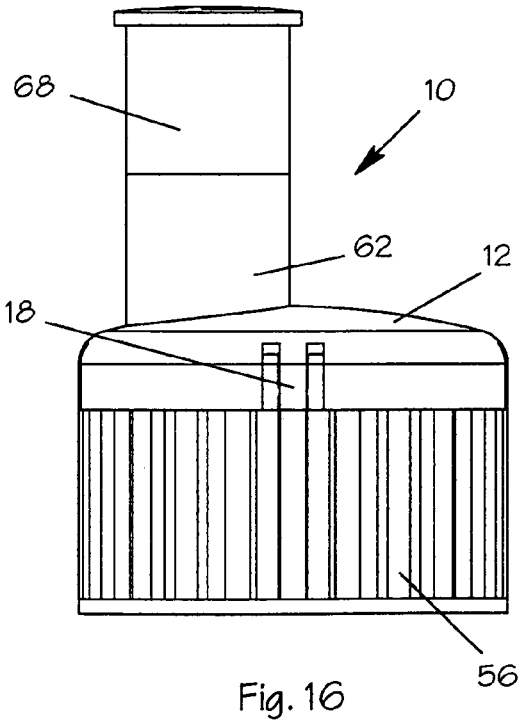
FIG. 16 is a right side elevation view of the second embodiment.
Figure 17:
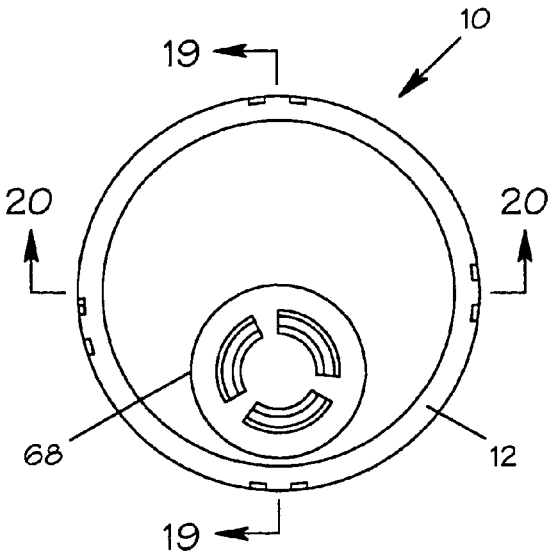
FIG. 17 is a top plan view of the second embodiment.
Figure 18:
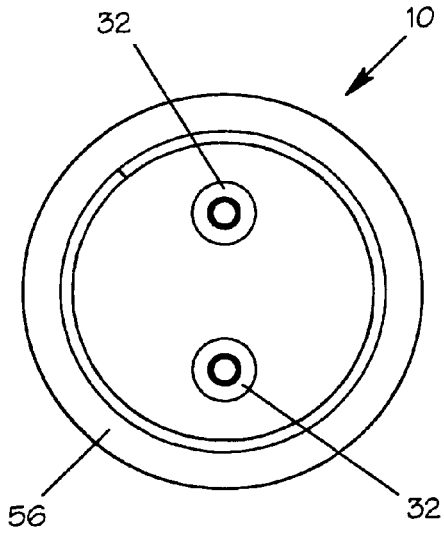
FIG. 18 is a bottom view of the second embodiment.
Figure 19:
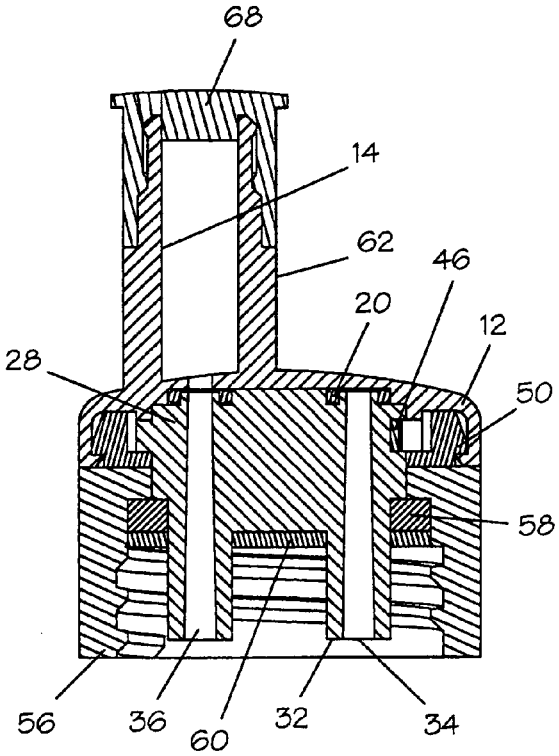
FIG. 19 is a cross-sectional view taken along lines 19—19 of FIG. 17.
Figure 20:
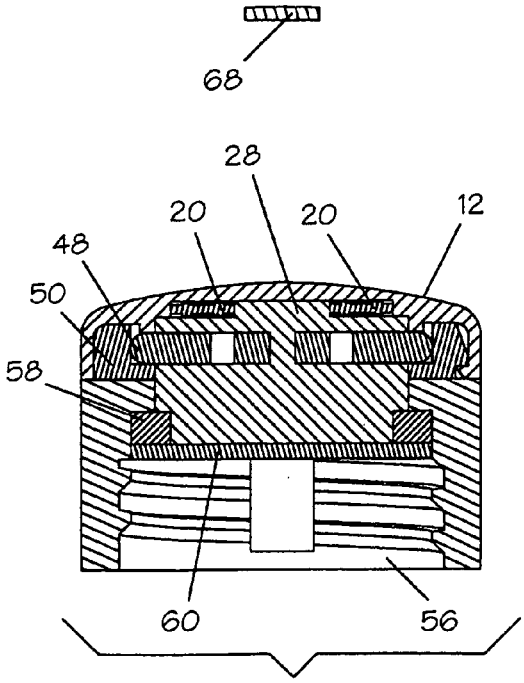
FIG. 20 is a cross-sectional view taken along lines 20—20 of FIG. 17.
Figure 21:
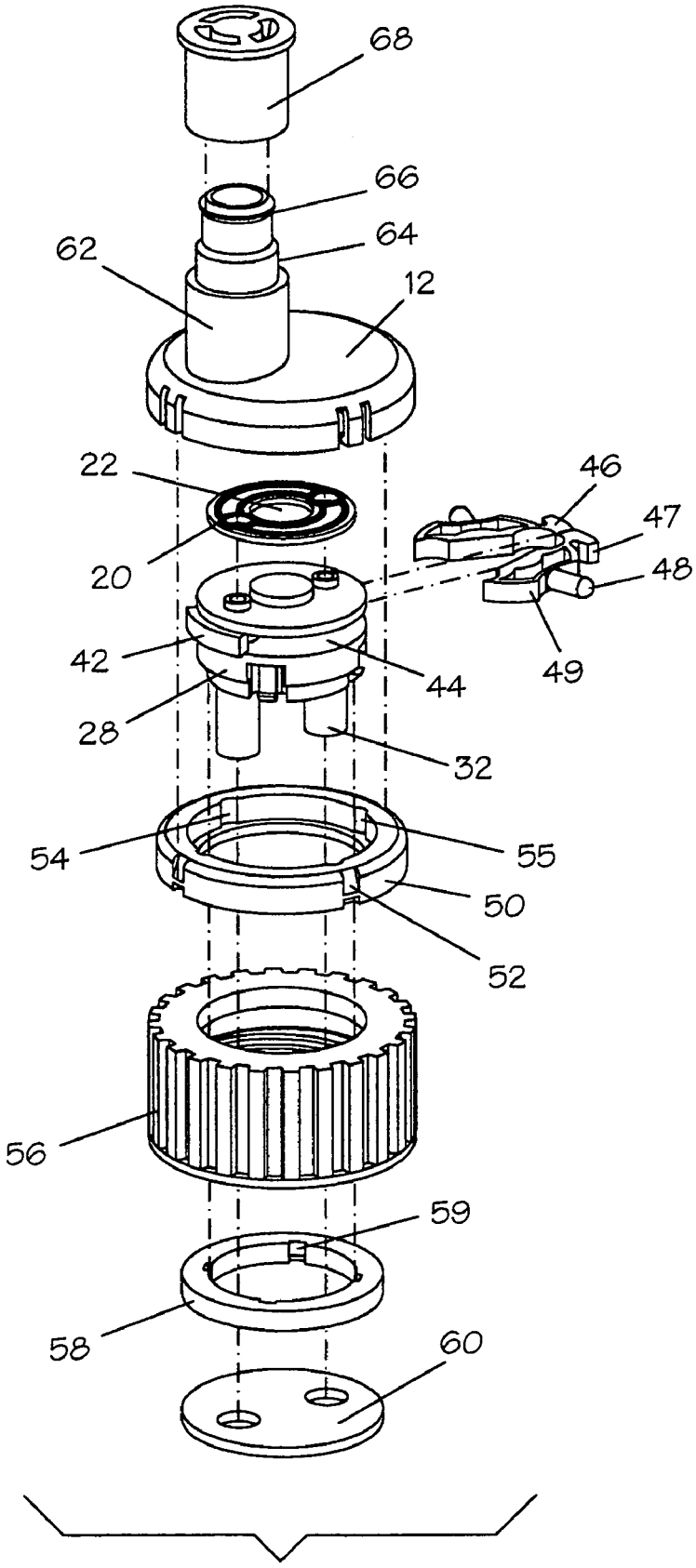
FIG. 21 is an exploded view of the second embodiment.
Figure 22:
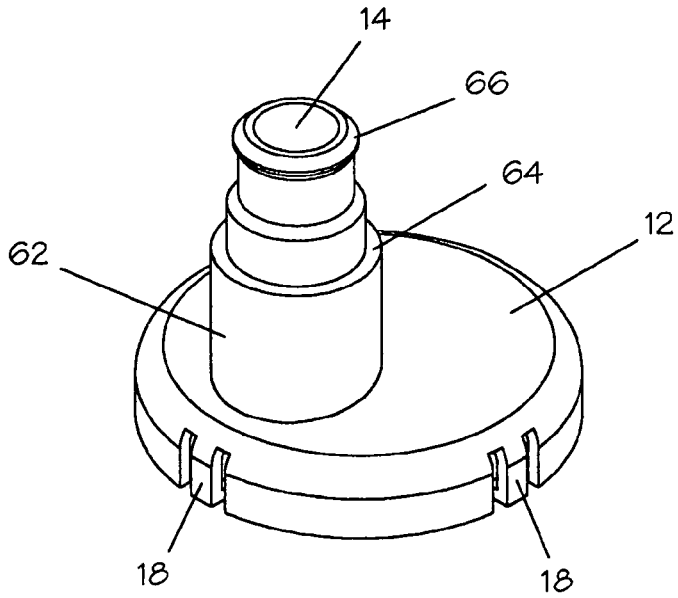
FIG. 22 is a partial isometric view of the upright outer housing of the second embodiment completely removed from the invention for clarity.
Figure 23:
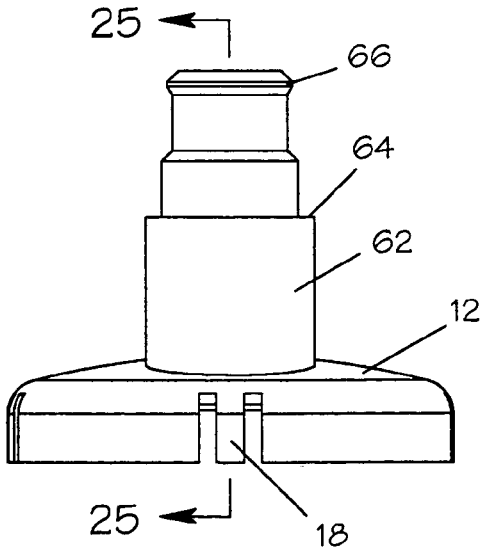
FIG. 23 is a front elevation view of the upright outer housing of the second embodiment completely removed from the invention for clarity.
Figure 24:
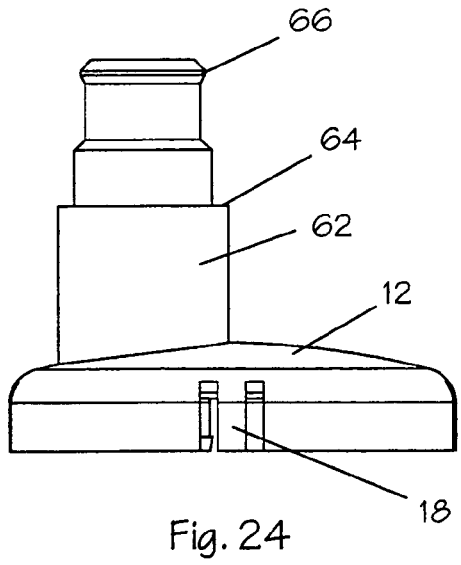
FIG. 24 is a right side elevation view of the upright outer housing of the second embodiment completely removed from the invention for clarity.
Figure 25:
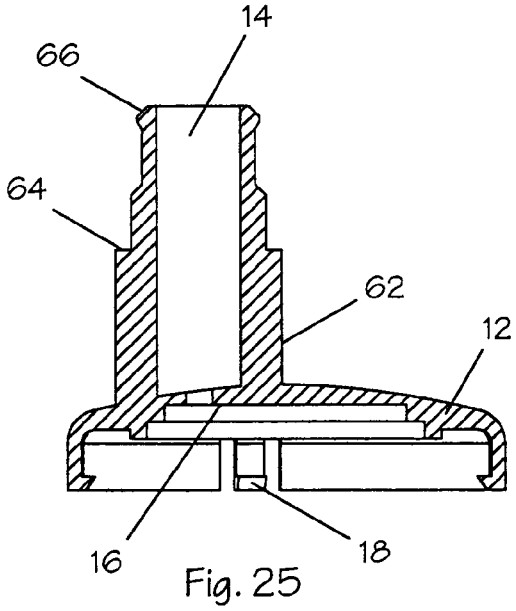
FIG. 25 is a cross-sectional view taken along lines 25—25 of FIG. 23.
Figure 26:
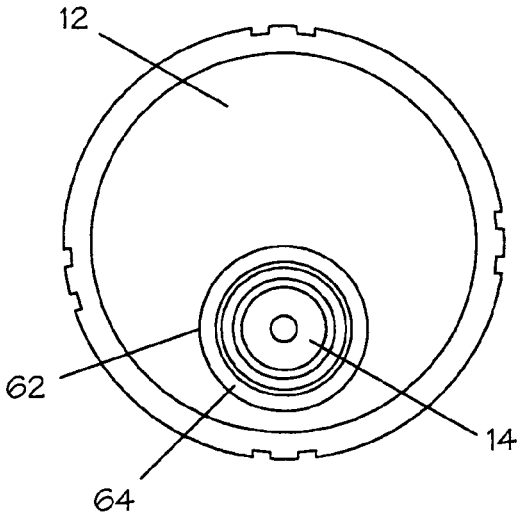
FIG. 26 is a top view of the upright outer housing of the second embodiment completely removed from the invention for clarity.
Figure 27:
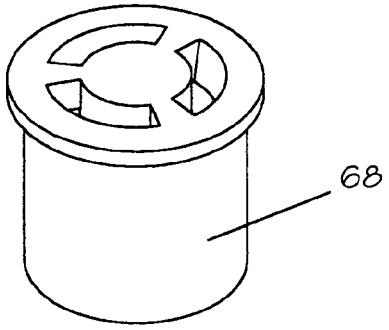
FIG. 27 is a partial isometric view of the push-pull closure of the second embodiment completely removed from the invention for clarity.
Figure 28:
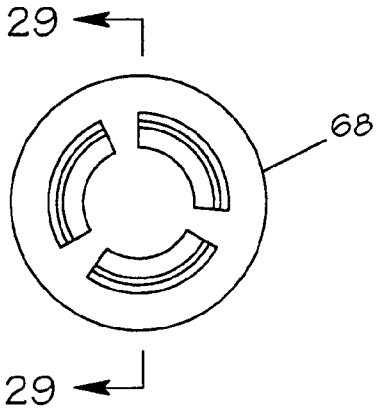
FIG. 28 is a top plan view of the push-pull closure of the second embodiment completely removed from the invention for clarity.
Figure 29:
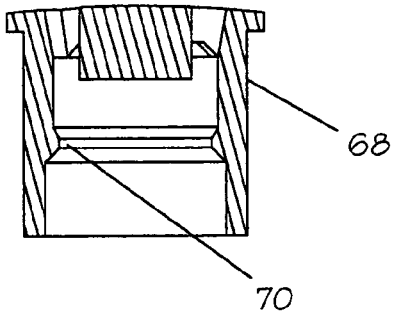
FIG. 29 is a cross-sectional view taken along lines 29—29 of FIG. 28.
Figure 30:
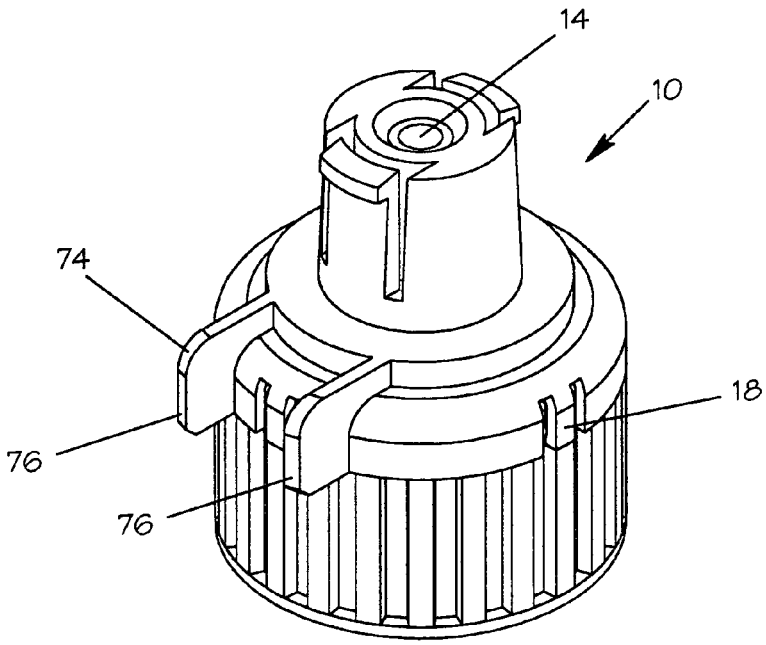
FIG. 30 is a partial isometric view of the third pump mountable embodiment.
Figure 31:
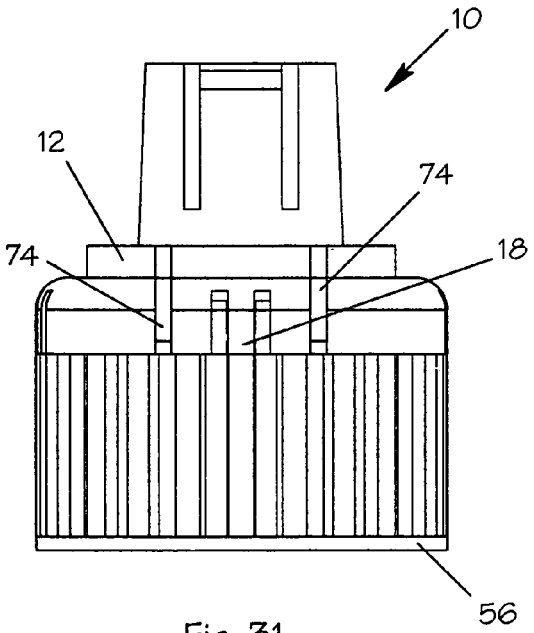
FIG. 31 is a front elevation view of the pump mountable third embodiment.
Figure 32:
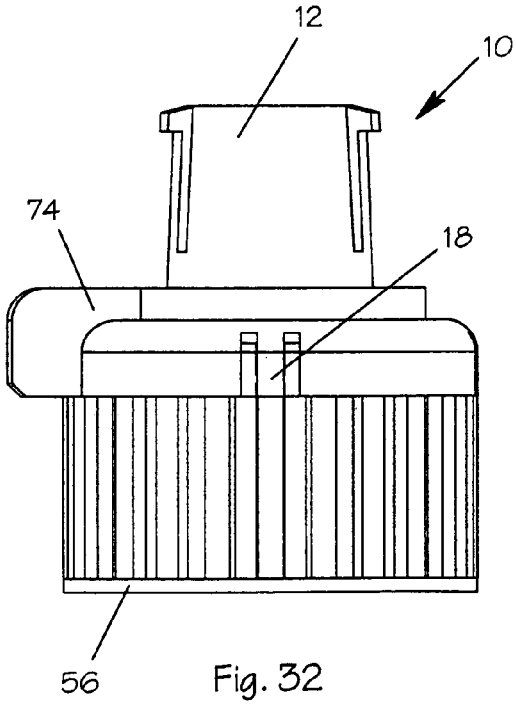
FIG. 32 is a right side elevation view of the third embodiment.
Figure 33:
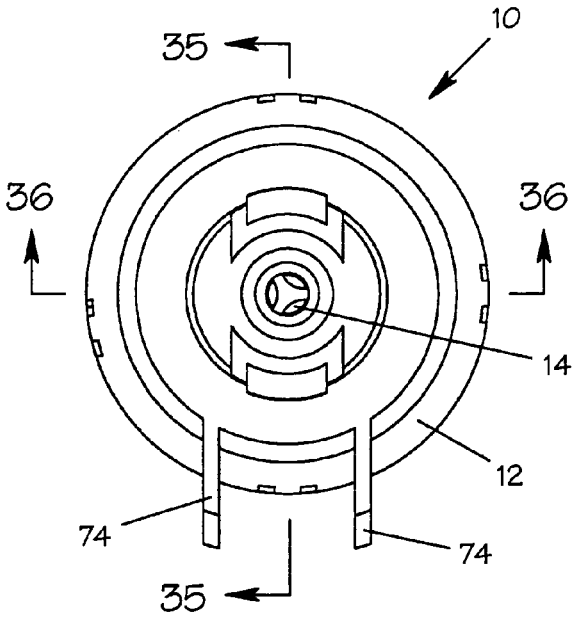
FIG. 33 is a top plan view of the third embodiment.
Figure 34:
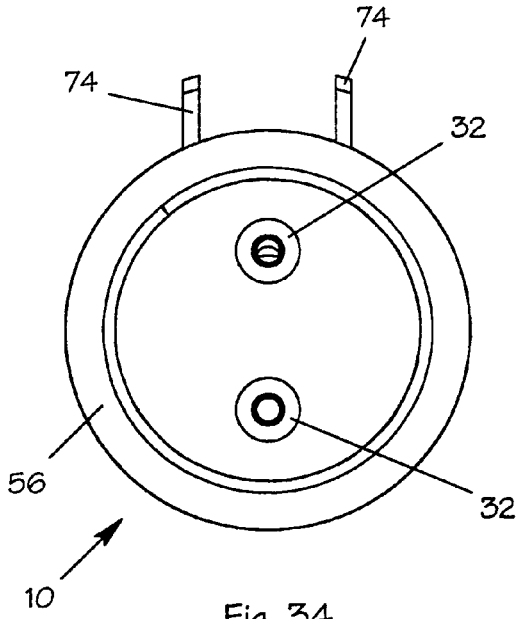
FIG. 34 is a bottom view of the third embodiment.
Figure 35:
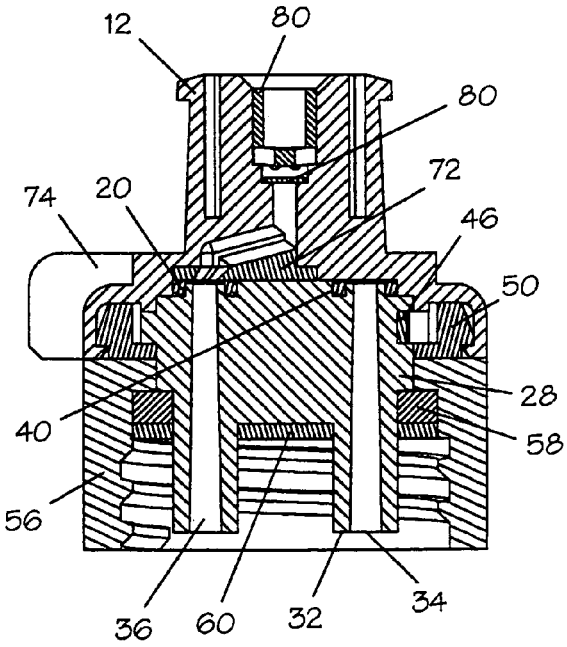
FIG. 35 is a cross-sectional view taken along lines 35—35 of FIG. 33.
Figure 36:
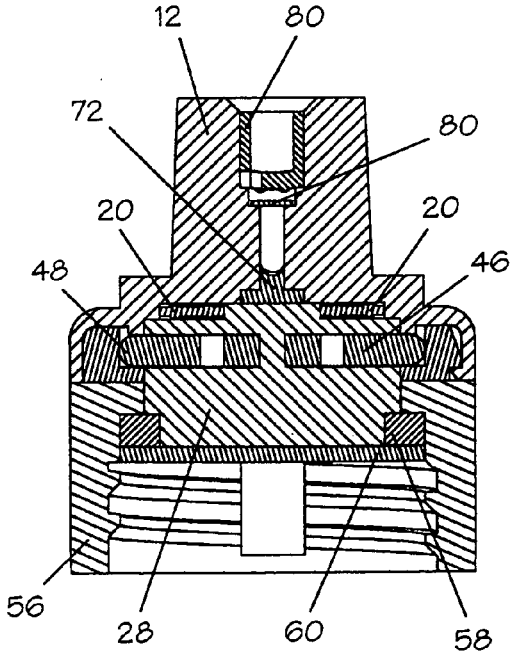
FIG. 36 is a cross-sectional view taken along lines 36—36 of FIG. 33.

The outer housing 12 is formed with a recessed inner surface 16, as best depicted in FIG. 12, and a plurality of peripheral, molded-in snap beams 18 that are integrally formed into the housing's outer vertical surface as illustrated. The outer housing offset bore 14 is suitable for use with pourable powders and fluids as it is funnel shaped, with a large opening on an upper exterior surface of the housing 12. It should also be noted that the offset bore 14 has a straight through fluid flow path, which allows the draining of fluids and venting, thus precluding the need for a separate vent.

An upper gasket 20, as shown in FIGS. 6, 7 and 45–47, contiguously engages the inner surface 16 of the outer housing 12 and is formed with a centrally located circular bore 22. The upper gasket 20 is molded with a combined multiple port and perimeter o-ring 24, which is formed integrally on both the upper and lower sides of the gasket. A groove 26 at the midpoint of the o-ring 24 limits the contact surface but permits ample material deflection, thus achieving a hermetic seal. As illustrated in the cross-sectional views of FIGS. 6 and 7, an inner housing 28 is in intimate contact with the upper gasket 20. The inner housing 28 includes an upper end 30 and a lower intake end 32, with the lower end 32 having a plurality of intake ports 34 and means thereon for releasably connecting the lower intake end 32 of the inner housing 28, by way of dip tubes (not shown) to at least two separate chambers of the container. Preferably, or at least two fluid communicating inner housing channels 36, are positioned between the upper 30 and lower intake end 32 for transporting fluid through the housing 28. The inner housing 28 further includes a plurality of peripheral molded-in snap beams 38, as shown best in FIG. 48. A raised boss 40 is formed on the upper end 30 of the inner housing 28 and is configured to interface with the circular hole 22 in the upper gasket 20. The boss 40 is used to maintain alignment during assembly and to form a spacer which prevents excessive compression of the upper gasket 20. The inner housing 28 contains a single fin guide 42 that rides on an interior shoulder of a detent ring, which is described infra, and supports the housing 28 when it is assembled. The inner housing 28 further contains a detent slot 44 for retaining a molded spring detent, which will also be subsequently described in detail. It should be noted that the inner housing 28 is illustrated by itself in FIGS. 48–50 and assembled in the cross-section views of FIGS. 6 and 7.

Figure 51:
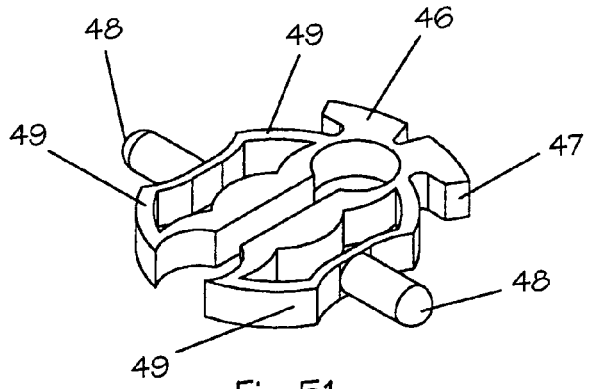
FIG. 51 is a partial isometric view of the molded spring detent of the preferred embodiment completely removed from the invention for clarity and shown compressed as it would be in use.
Figure 52:
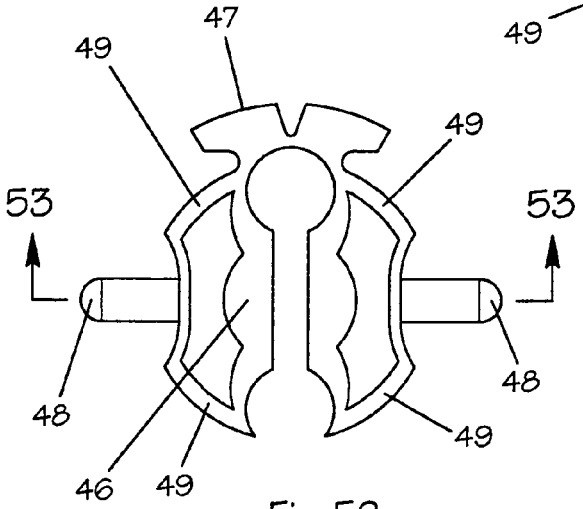
FIG. 52 is a top plan view of the molded spring detent of the preferred embodiment completely removed from the invention for clarity and shown compressed as it would be in use.
Figure 53:
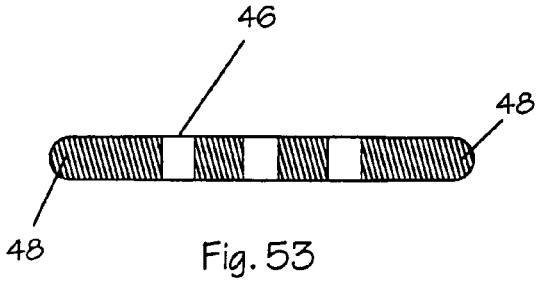
FIG. 53 is a cross-sectional view taken along lines 53—53 of FIG. 52.
Figure 54:
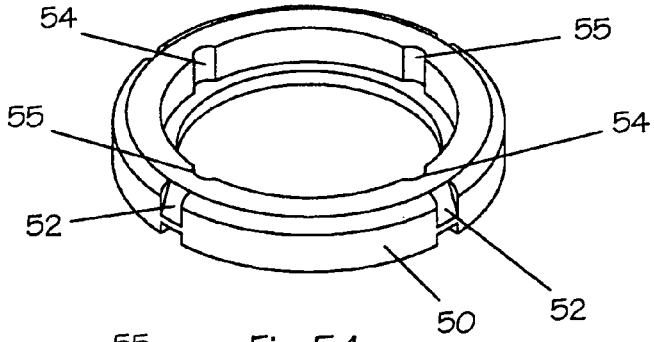
FIG. 54 is a partial isometric view of the detent ring of the preferred embodiment completely removed from the invention for clarity.
Figure 55:
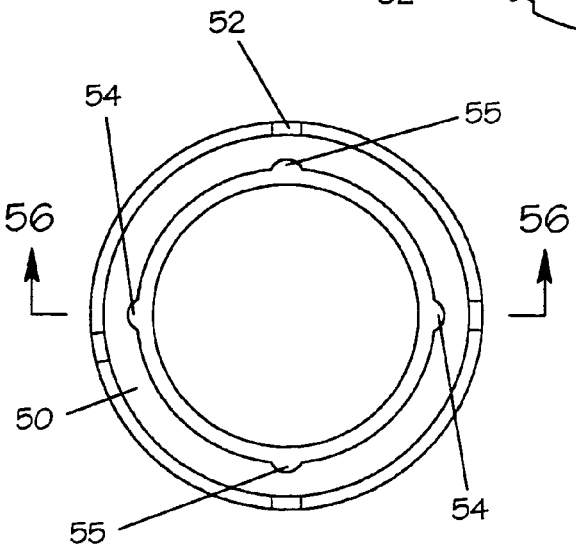
FIG. 55 is a top plan view of the detent ring of the preferred embodiment completely removed from the invention for clarity.
Figure 56:
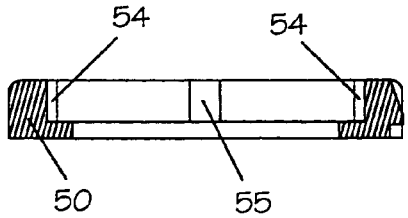
FIG. 56 is a cross-sectional view taken along lines 56—56 of FIG. 55.
Figure 57:
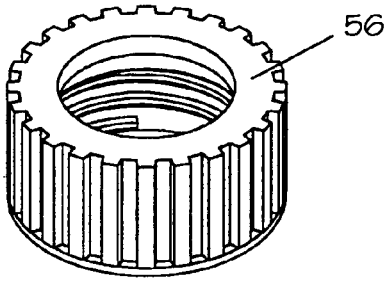
FIG. 57 is a partial isometric view of the threaded closure of the preferred embodiment completely removed from the invention for clarity.
Figure 59:
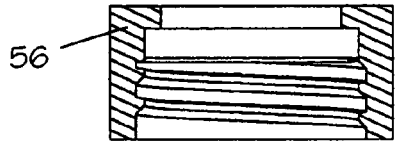
FIG. 59 is a cross-sectional view taken along lines 59—59 of FIG. 58.
Figure 58:
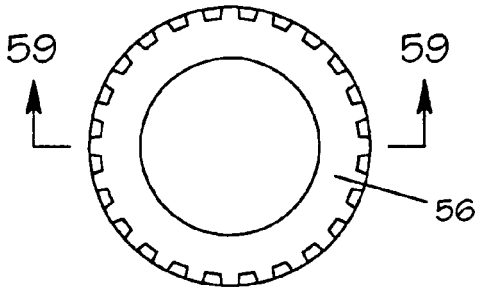
FIG. 58 is a top plan view of the threaded closure of the preferred embodiment completely removed from the invention for clarity.
Figure 60:
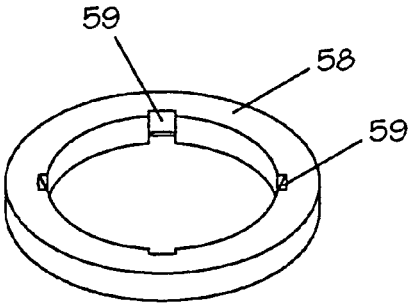
FIG. 60 is a partial isometric view of the lower stop ring of the preferred embodiment completely removed from the invention for clarity.
Figure 62:
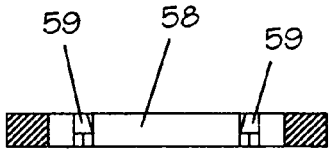
FIG. 62 is a cross-sectional view taken along lines 62—62 of FIG. 61.
Figure 61:
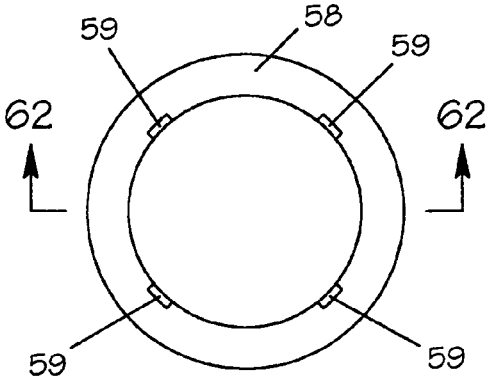
FIG. 61 is a top plan view of the lower stop ring of the preferred embodiment completely removed from the invention for clarity.
Figure 64:
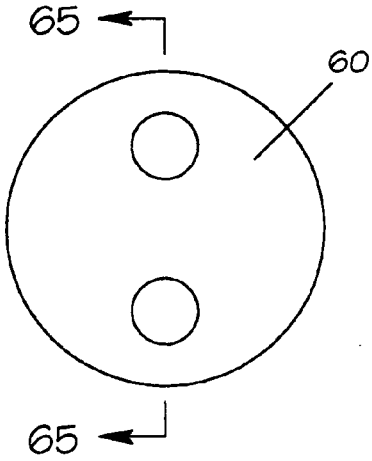
FIG. 64 is a top plan view of the lower gasket of the preferred embodiment completely removed from the invention for clarity.
Figure 63:
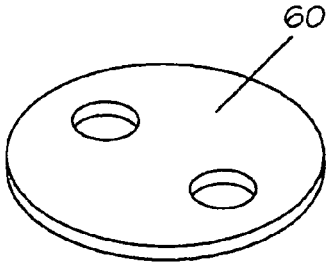
FIG. 63 is a partial isometric view of the lower gasket of the preferred embodiment completely removed from the invention for clarity.
Figure 65:
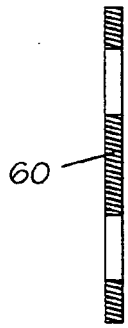
FIG. 65 is a cross-sectional view taken along lines 65—65 of FIG. 64.
Figure 66:
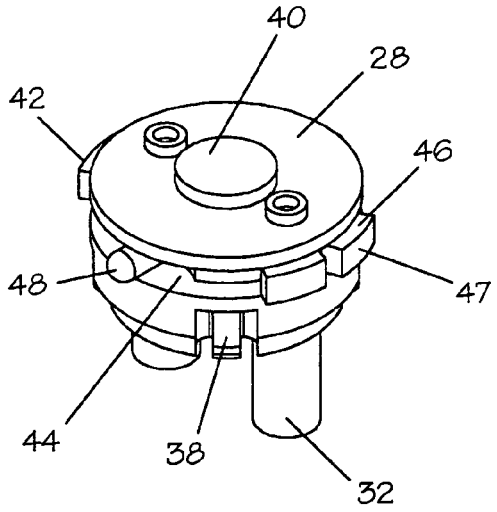
FIG. 66 is a partial isometric view of the spring detent assembled into the detent slot of the inner housing.
Figure 67:
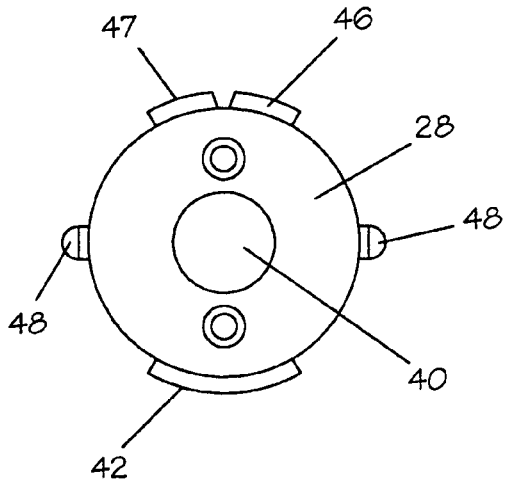
FIG. 67 is a top plan view of the spring detent assembled into the detent slot of the inner housing.

The molded spring detent 46, as illustrated in FIGS. 51–53, is horizontally positioned within the detent slot 44 of the inner housing 28. The molded spring detent 46 includes a pair of outward-extending cylindrical round nose pins 48 that protrude externally when the detent 46 is slideably disposed onto the inner housing 28. The molded spring detent 46 is formed of a resilient thermoplastic material, thereby permitting spring action at three places, the first being at the mid section of the opposing single fin guide 47, which flexes to allow the spring detent to open up, much like a clothes pin, during assembly of the spring detent into the detent slot 44 of the inner housing 28. The spring detent also flexes, acting more like polymer spring, at each of the polymer spring shaped arms 49 which extend outward from each side of each round nose pin 48, which urges the outward-protruding nose pins 48 to retain a positive force under compression. The design of the assembled spring detent and inner housing parts is a very important element of the preferred embodiment as shown in FIGS. 66 and 67. This inventive two part assembly forms the "dual" opposing single fin guides 42 and 47, one in each part, which were previously embodied in the inner housing of my patent U.S. Pat. No. 5,370,275. It is the dual opposing single fin guides of the two different parts, which effectively stabilize the valves rotating parts, as they rotate.

The final element in the preferred embodiment is a detent ring 50, as best illustrated in FIGS. 54–56 and FIGS. 68–69, that has a plurality of snap-in slots 52 interfacing with the snap beams 18 of the outer housing 12. The detent ring 50 also includes a plurality of flow and shut-off positions, with each position defined as a pair of radial grooves 54 and 55 that interface with the opposing round nose pins 48, of the spring detent 46. The relationship of the detent pins 48 and grooves 54 and 55, provide securement, in that when the outer housing is rotated, the pins 48 sequentially enter the pair of opposing grooves 54 to maintain a flow position, and then the pair of opposing grooves 55, to maintain a shut-off position thereby maintaining the outer housing at a desired position.

Figure 68:
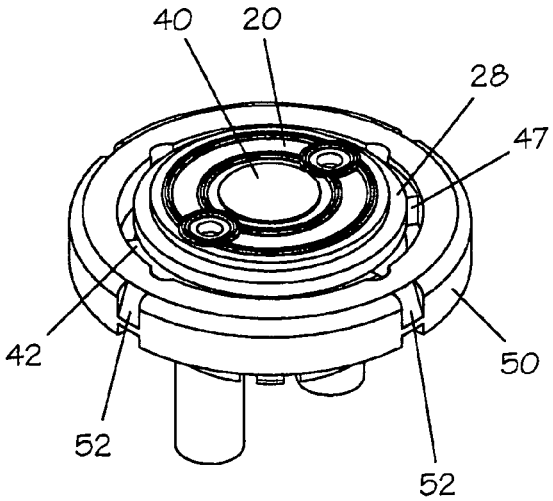
FIG. 68 is a partial isometric view of the upper gasket and spring detent assembled into the inner housing which, in turn, are assembled into the detent ring.
Figure 69:
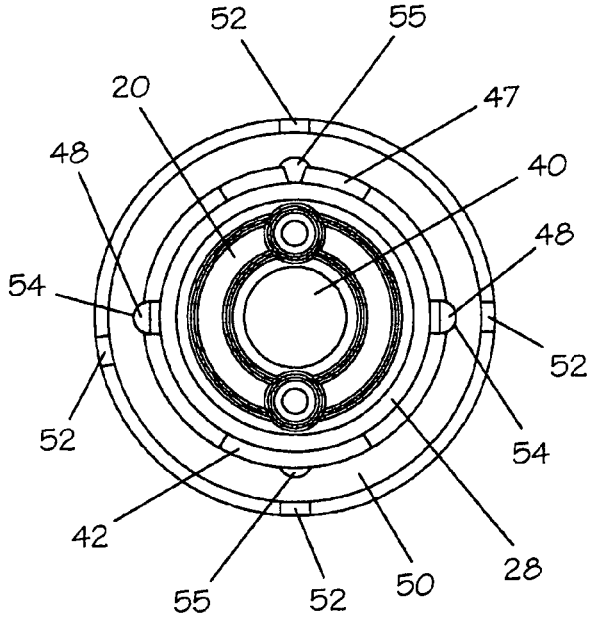
FIG. 69 is a top plan view of the upper gasket and spring detent assembled into the inner housing which, in turn, are assembled into the detent ring.

The detent ring 50 is configured to capture and hold the inner housing 28, spring detent 46, and upper gasket 20, as best shown in FIG. 68, onto the outer housing 12 as an upper sub-assembly with snap action when the snap-in slots 52 of the detent ring 50 receive the snap beams 18 of the outer housing 12.

A lower closure sub-assembly is included in the preferred embodiment and is also disclosed in my previous patent U.S. Pat. No. 5,370,275. The closure assembly consists of the combination of a threaded closure 56 with a lower stop ring 58 and lower gasket 60 disposed thereon. The closure assembly attaches directly to the multi-chambered fluid container utilizing the threaded closure 56, with the lower gasket 60 providing a seal therebetween.

The above-described lower sub-assembly is assembled by way of the snap beams 38 on the inner housing 28 interfacing with the snap in slots 59 of the lower stop ring 58 completing the selection valve 10. The snap action of the upper and lower sub-assemblies allows the selection valve 10 to be suitable for either robotic or by hand snap-in assembly, which presents considerable commercial value.

From the above description of the elements of the selection valve 10 it may be realized that a fluid flow path is formed between a specific compartment in the container to the offset bore 14 in the outer housing 12. The flow path is selected by rotating the outer housing 12 relative to the threaded closure 56 attached to the multi-chambered fluid container. An off-position is also provided when the rotation stops between the chambers, thus blocking the flow path while being held in this position by the pins 48 of the spring detent 46 resting in the provided slots 55 in the detent ring 50.

The second embodiment, as illustrated in FIGS. 14–29 and FIGS. 45–69, is basically the same as the preferred embodiment with the exception of the outer housing, which instead of having a funnel shape is comprised of a cylindrical spout 62 having the offset bore 14 therethrougth and a stepped shoulder 64 with an outward-protruding offset bead 66 on a distal end.

A push pull closure 68 is slideably disposed on the cylindrical spout 62, and the closure 68 contains an offset bead 70 that corresponds to the outward-protruding offset bead 66 on the distal end of the spout 62. The offset bead 70 of the closure 68, being made of a resilient thermoplastic material, snaps over the offset bead 66 on the distal end of the spout 62. Upon assembly, the offset bead 66 acts as a stop for the offset bead 70 of the closure 68. The closure 68 plugs the bore 14 when urged downward on the spout 62, while a clear flow path is formed when pulled away from the spout end. The protruding bead 66 on the distal end of the spout 62 prohibits removal of the closure 68 from the spout 62.

Figure 37:
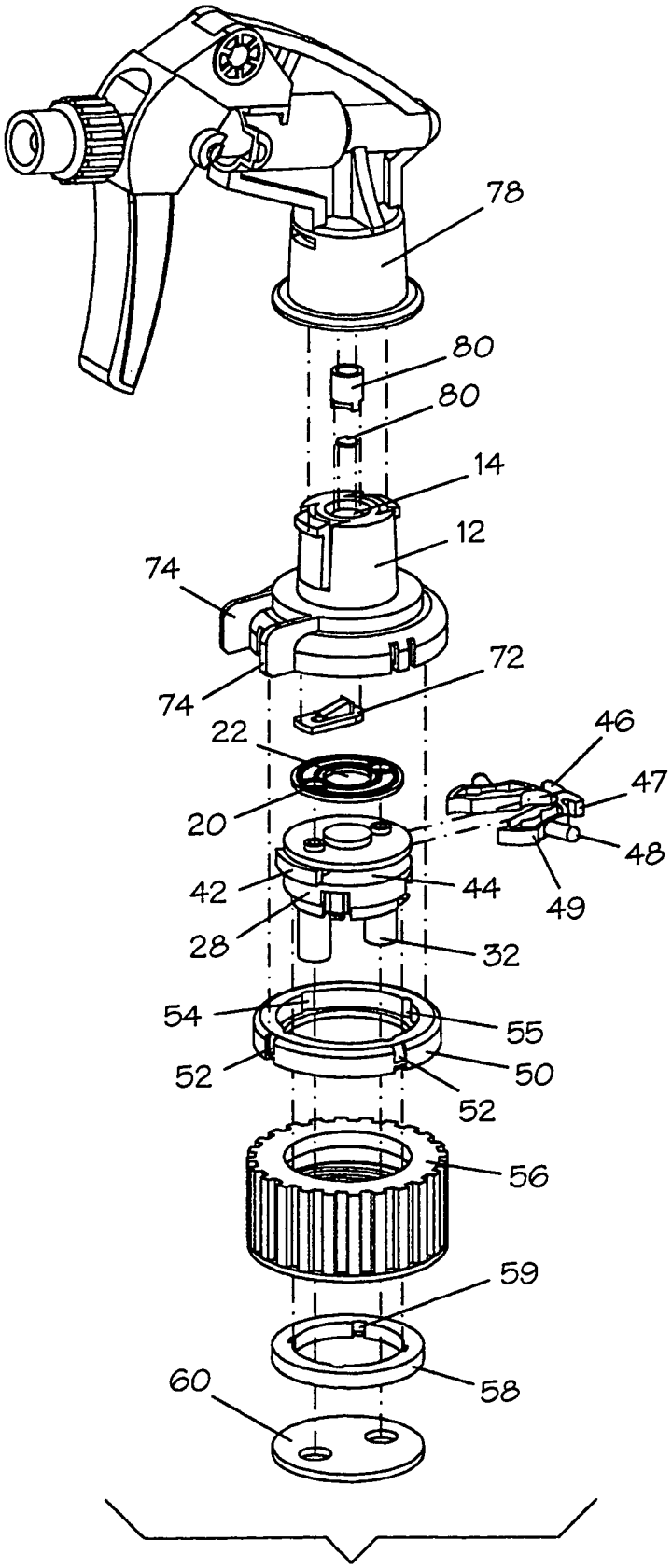
FIG. 37 is an exploded view of the third embodiment including a prior art trigger sprayer and check valve assembly.
Figure 38:
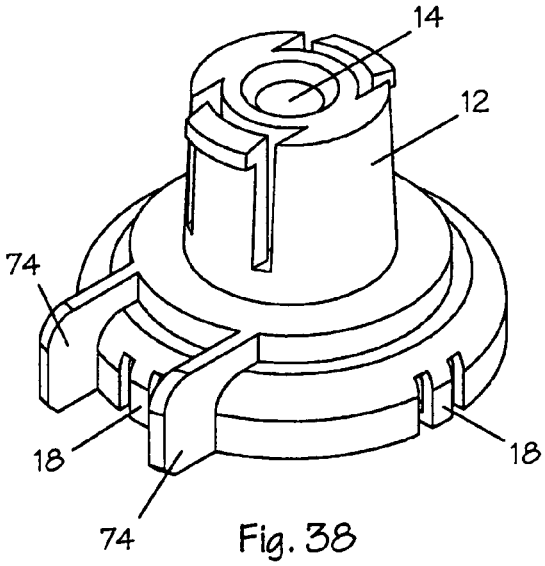
FIG. 38 is a partial isometric view of the pump mountable outer housing of the third embodiment completely removed from the invention for clarity.
Figure 40:
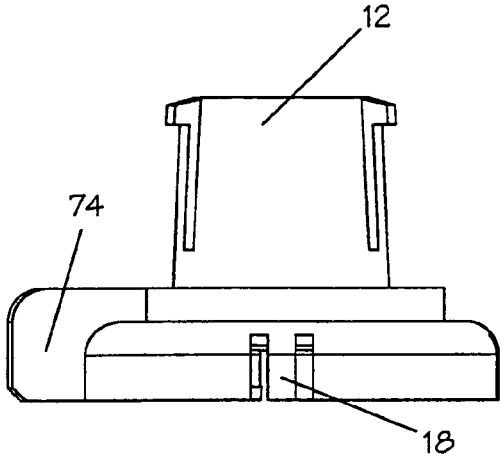
FIG. 40 is a right side elevation view of pump mountable outer housing of the third embodiment completely removed from the invention for clarity.
Figure 39:
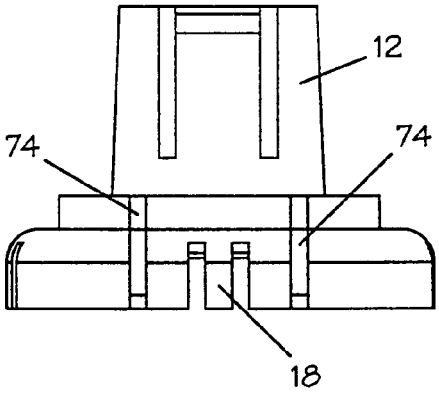
FIG. 39 is a front elevation view of the pump mountable outer housing of the third embodiment completely removed from the invention for clarity.
Figure 41:
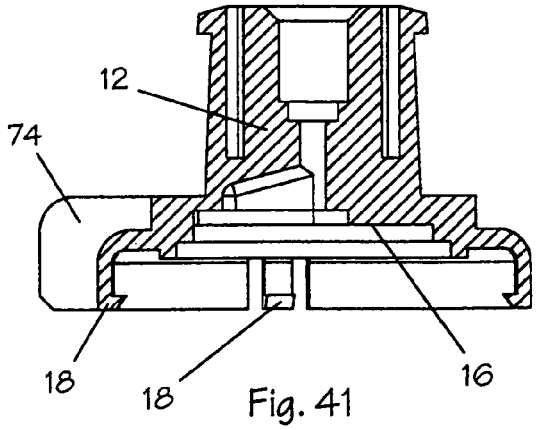
FIG. 41 is a cross-sectional view taken along lines 41—41 of FIG. 39.
Figure 42:
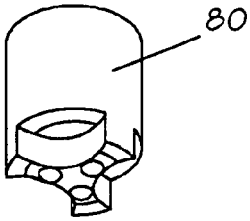
FIG. 42 is a partial isometric bottom front view of the prior art check valve body of the third embodiment completely removed from the invention for clarity.
Figure 43:
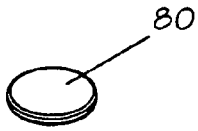
FIG. 43 is a partial isometric view of the prior art check valve disc of the third embodiment completely removed from the invention for clarity.
Figure 44:
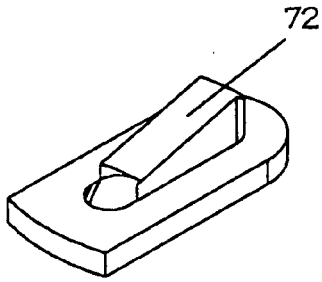
FIG. 44 is a partial isometric view of the L-shaped seal plate of the third embodiment completely removed from the invention for clarity.
Figure 45:
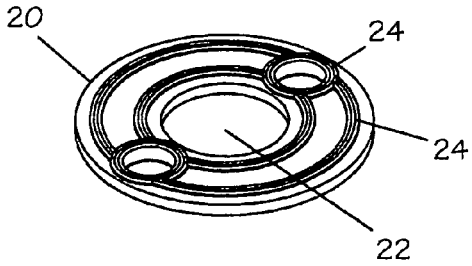
FIG. 45 is a partial isometric view of the upper gasket of the preferred embodiment completely removed from the invention for clarity.
Figure 46:
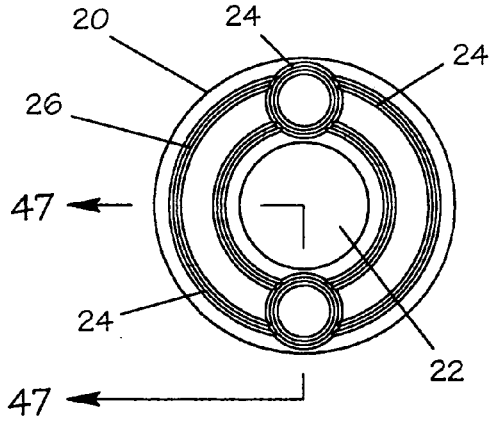
FIG. 46 is a top plan view of the upper gasket of the preferred embodiment completely removed from the invention for clarity.
Figure 47:
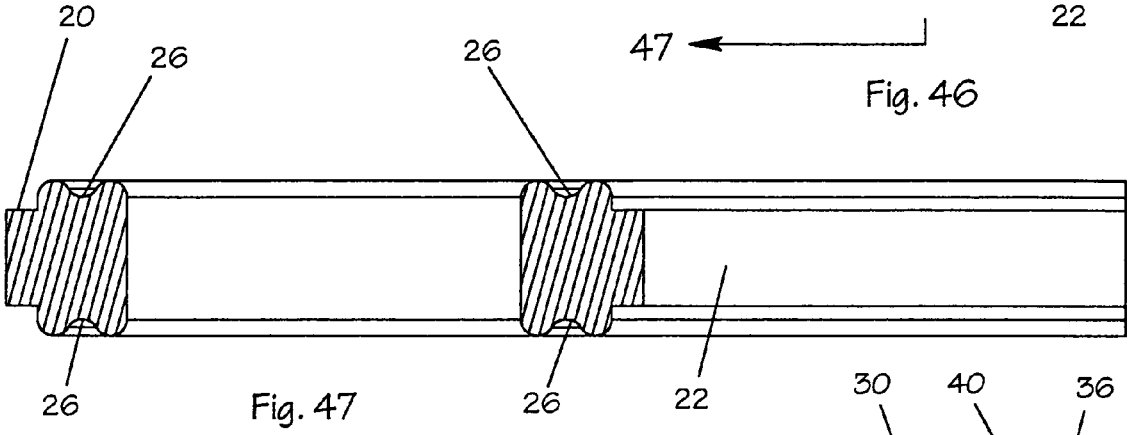
FIG. 47 is a cross-sectional view taken along lines 47—47 of FIG. 46.
Figure 48:
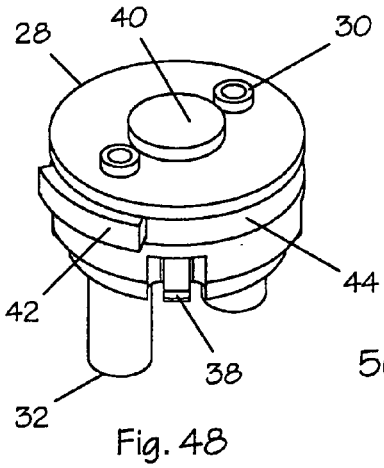
FIG. 48 is a partial isometric view of the inner housing of the preferred embodiment completely removed from the invention for clarity.
Figure 50A:
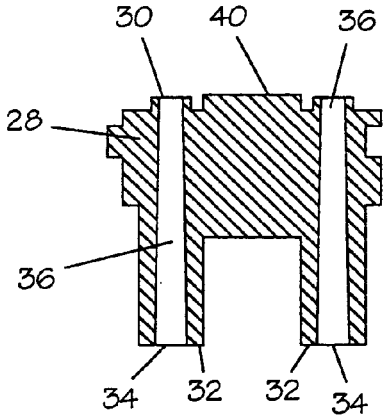
FIG. 50*a* is a cross-sectional view taken along lines 50*a*—50*a* of FIG. 49.
Figure 49:
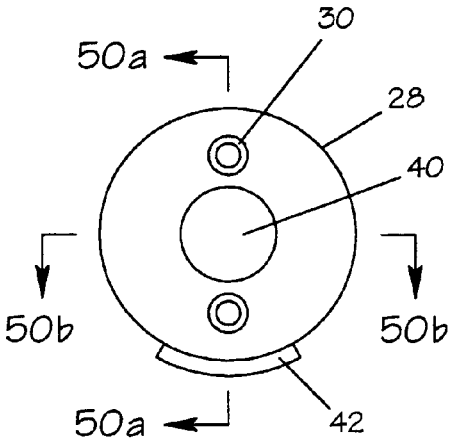
FIG. 49 is a top plan view of the inner housing of the preferred embodiment completely removed from the invention for clarity.
Figure 50B:
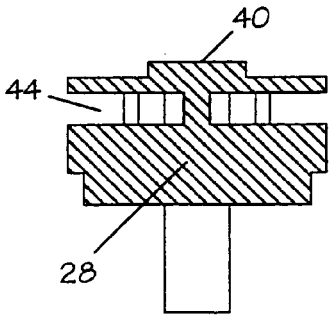
FIG. 50*b* is a cross-sectional view taken along the lines 50*b*—50*b* of FIG. 49.

The third embodiment is illustrated in FIGS. 30–69 and again differs only in the configuration of the outer housing 12, which is now pump mountable. Instead of the straight through fluid flow path of the first two embodiments, an L-shaped fluid path forms the offset bore 14, which requires the outer housing 12 to include a seal plate 72, shown in cross section in FIGS. 35 and 36 and by itself in FIG. 44. The embodiment of the seal plate is new and improved. Whereas the seal plate embodied in my patent U.S. Pat. No. 5,370,275 was a large circular flat plate with two holes, one a through flow hole and the other a locator hole for a corresponding pin in the outer housing, this seal plate is much smaller and rectangular in shape. It also features an angled step which significantly reduces the interior volume and any residuals which may be present when switching from one fluid to a different chamber and fluid. It should also be noted that the raised boss 40 on the inner housing 28 captures the improved seal plate and retains it up into the outer housing 12. Another difference in the outer housing 12 is the addition of a lift ledge and finger guard 74 which consists of a pair of parallel arms 76 extending from an outer face of the outer housing 12 to provide a surface for lifting a fluid container. A pump 78, which is shown in FIG. 37, and well known in the art, is attached to the selection valve 10 and the parallel arms 76, in concert, protect ones fingers from being pinched by the pump trigger when operating the pump 78. The prior art pump 78 shown is only representative, as the mold to make the housing 12 is adaptable to any on-the-market pump. The outer housing 12 also utilizes the check valve assembly, and the parts thereof, of the pump it is adapted to. Thus, when this particular pump 78 is used, it is necessary to add its two-piece check valve 80, which is disposed within the bore 14, as illustrated in FIGS. 35, 36, 42 and 43. Other trigger sprayers may use different check valve assemblies which may include parts in the form of disks or balls of various sizes with and without retainers.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A selection valve for a multi-chambered fluid container that includes a plurality of container outlet openings in fluid communication with various container chambers for storing fluids therein comprising:

a) an outer housing having a bore therethrough for receiving and conducting as singular fluid from a multi-chambered container, said outer housing suitable for use with pourable powders and liquids, b) an upper gasket contiguously engaging the inner surface of said outer housing, c) an inner housing contacting the upper gasket said inner housing having a plurality of intake ports for fluid communication between the outer housing and a fluid container, d) a molded spring detent having a pair of outward-extending cylindrical rounded nose pins slideably disposed upon the inner housing with the pins protruding externally, e) a detent ring interfacing with the inner housing and spring detent, wherein when the outer housing is rotated the inner housing remains at a desired location, and f) a closure assembly snapped into the inner housing thus permitting a fluid flow path to be formed between a specific compartment in the container and the bore in the outer housing, which is selected by rotating the outer housing relative to the threaded closure attached to the fluid container.

2. A selection valve for a multi-chambered fluid container that includes a plurality of container outlet openings in fluid communication with various container chambers for storing fluids therein comprising:

a) an outer housing having a bore therethrougth for receiving and conducting a singular fluid from a multi-chambered container, said outer housing having a cylindrical spout with a bore therethrougth and a stepped shoulder with an outward-protruding bead on a distal end and a push-pull closure slideably disposed upon the cylindrical spout, b) an upper gasket contiguously engaging the inner surface of said outer housing, c) an inner housing contacting the upper gasket, said inner housing having a plurality of intake ports for fluid contact between the outer housing and the fluid container, d) a molded spring detent having a pair of outward-extending cylindrical round nose pins slideably disposed upon the inner housing with the pins protruding externally, e) a detent ring interfacing with the inner housing and spring detent wherein when the outer housing is rotated the inner housing remains at a desired location, and f) a closure assembly snapped into the inner housing, thus permitting a fluid flow path to be formed between a specific compartment in a container and the bore in the outer housing, which is selected by rotating the outer housing relative to the threaded closure attached to the fluid container.

3. A selection valve for a multi-chambered fluid container that includes a plurality of container outlet openings in fluid communication with various container chambers for storing fluids therein comprising:

a) an outer housing having a bore therethrough for receiving and conducting a singular fluid from a multi-chambered container, said outer housing further comprises an L-shaped fluid path forming an offset bore, and a lift ledge and finger guard, b) an upper gasket contiguously engaging the inner surface of said outer housing, c) an inner housing contacting the upper gasket, said inner housing having a plurality of intake ports for fluid contact between the outer housing and a fluid container, d) a molded spring detent having a pair of outward-extending cylindrical round nose pins slideably disposed upon the inner housing with the pins protruding externally, e) a detent ring interfacing with the inner housing and spring detent, wherein when the outer housing is rotated the inner housing remains at a desired location, and f) a closure assembly snapped into the inner housing, thus permitting a fluid flow path to be formed between a specific compartment in a container and the bore in the outer housing, which is selected by rotating the outer housing relative to the threaded closure attached to the fluid container.

* * * * *